United States Patent [19]

Kohn

[11] 4,330,141

[45] May 18, 1982

[54] ADJUSTABLE PIPE UNION

[75] Inventor: Gary A. Kohn, Dallas, Tex.

[73] Assignee: Otis Engineering Corporation, Dallas, Tex.

[21] Appl. No.: 126,689

[22] Filed: Mar. 3, 1980

[51] Int. Cl.[3] ..... F16L 15/02

[52] U.S. Cl. ..... 285/93; 285/302; 285/341; 285/355; 285/356

[58] Field of Search ..... 285/355, 356, 357, 333, 285/393, 351, 93, 341, 302

[56] References Cited

U.S. PATENT DOCUMENTS

| | | | |
|---|---|---|---|
| 255,734 | 3/1882 | Moore | 285/356 X |
| 259,449 | 6/1882 | Woodring et al. | 285/356 X |
| 2,772,100 | 11/1956 | Kreissig et al. | 285/357 X |
| 3,166,345 | 1/1965 | Pinkard | 285/93 X |
| 3,711,126 | 1/1973 | Hara et al. | 285/356 X |
| 4,012,060 | 3/1977 | Reneau | 285/93 |

FOREIGN PATENT DOCUMENTS

| | | | |
|---|---|---|---|
| 635412 | 1/1962 | Canada | 285/333 |

*Primary Examiner*—Thomas F. Callaghan
*Attorney, Agent, or Firm*—H. Mathews Garland

[57] ABSTRACT

An adjustable pipe union for tubing strings including an outer lower mandrel, an inner upper mandrel threaded along a lower end portion into the outer mandrel, packing between the mandrels, an annular seal chamber between the mandrels, a metal-to-metal seal assembly between the mandrels, and a jam nut threaded into an end portion of the outer mandrel around the inner mandrel against the metal-to-metal seal expanding the seal to lock the members together and seal between the members. A short embodiment of the union permits rotational orientation of tubing string apparatus such as valves. A longer embodiment of the union performs a spacing-out function for fitting a tubing string assembly between longitudinally spaced fixed members such as two packers.

9 Claims, 6 Drawing Figures

ADJUSTABLE PIPE UNION

This invention relates to pipe fittings and more particularly to adjustable pipe unions for connecting spaced tubular members connected together in a tubing string.

In pipe structures particularly tubing strings used for fluid flow in the oil and gas industry it is frequently necessary to include in a tubing string devices such as flow control valves having external structure such as lugs which might interfere with an adjacent member such as another tubing string unless the valve is properly oriented. Also, it is frequently necessary to connect a tubing string between fixed members such as packers mounted with a plurality of tubing strings requiring that those strings connected between the packers after the first string be capable of being spaced-out in order to fit them between the two fixed packers. One solution to the problems of orientation and spacing-out in multiple tubing string use has been adjustable pipe unions. Such unions presently known to exist have several undesirable characteristics. One problem with such unions is excessive loading on the threads connecting the main body or mandrel portions of the union together. Such loading may result in thread failure. Another problem with existing pipe unions is seal failure between the mandrel or body members of the union.

It is a particularly important object of the present invention to provide a new and improved adjustable pipe union.

It is another object of the invention to provide an adjustable pipe union which does not place longitudinal loading on the adjusting threads connecting the mandrels of the union together.

It is another object of the invention to provide an adjustable pipe union which includes not only packing between the union mandrels but also a metal-to-metal seal assembly sealing and locking the mandrels together.

It is another object of the invention to provide an adjustable pipe union having an annular chamber between the union mandrels for seal test purposes and for an injected sealing material between the mandrels.

It is another object of the invention to provide an adjustable pipe union which may be used for rotational orientation of tubing string apparatus.

It is another object of the invention to provide an adjustable pipe union used for spacing-out between fixed connected members.

It is another object of the invention to provide an adjustable pipe union having inner and outer mandrels threaded together, packing between the mandrels, a metal-to-metal seal assembly between the mandrels, a jam nut expanding the metal-to-metal seal assembly between the mandrels, and a seal and test chamber between the mandrels.

In accordance with the invention there is provided an adjustable pipe union having a first outer tubular mandrel, a second inner tubular mandrel threaded along an end portion into the outer mandrel, packing between the inner and outer mandrels, a metal-to-metal seal between the mandrels, a jam nut threaded into the outer mandrel around the inner mandrel against the metal-to-metal seal expanding the seal, and an annular test and seal chamber between the mandrels.

The foregoing objects and advantages of the present invention will be better understood from the following detailed description of preferred embodiments thereof taken in conjunction with the accompanying drawings wherein.

Figure 1:
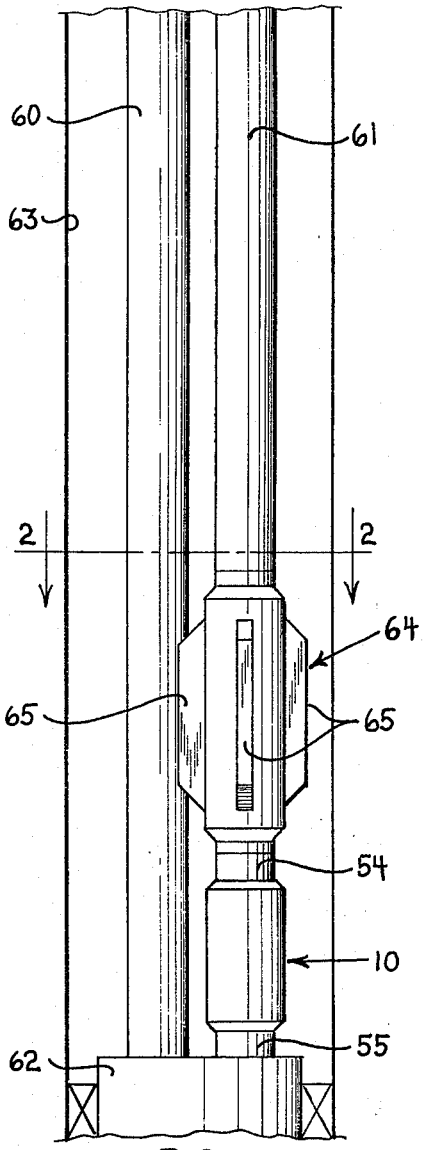
FIG. 1 is a schematic view in longitudinal section and elevation of a pair of tubing strings connected with a packer in a well bore including a tubing safety valve in one of the tubing strings oriented by means of an adjustable pipe union embodying the features of the invention.
Figure 3A:
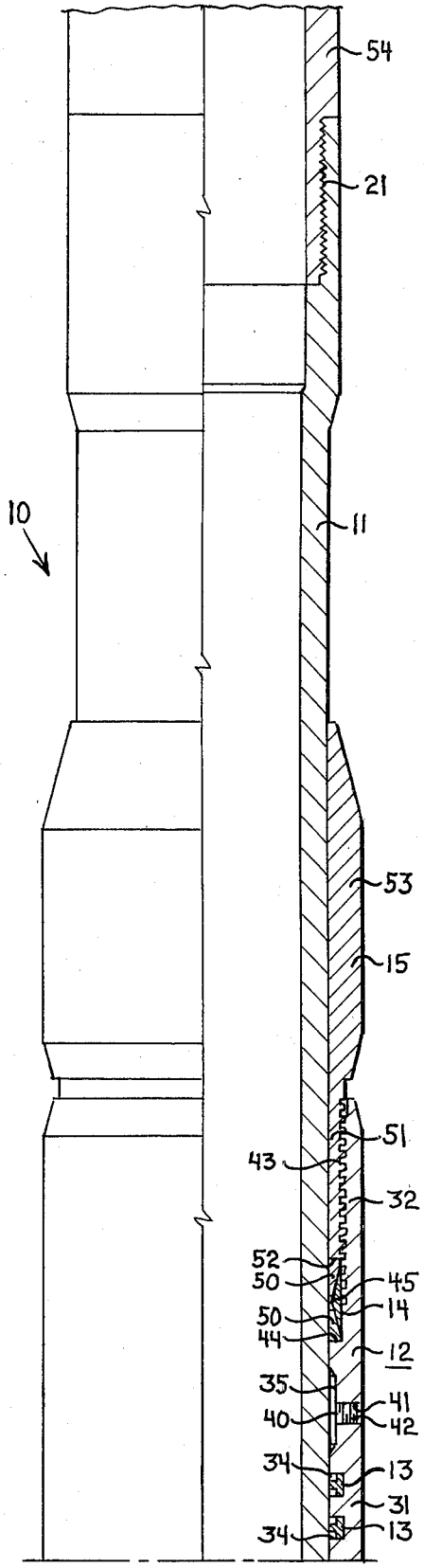
Figure 3B:
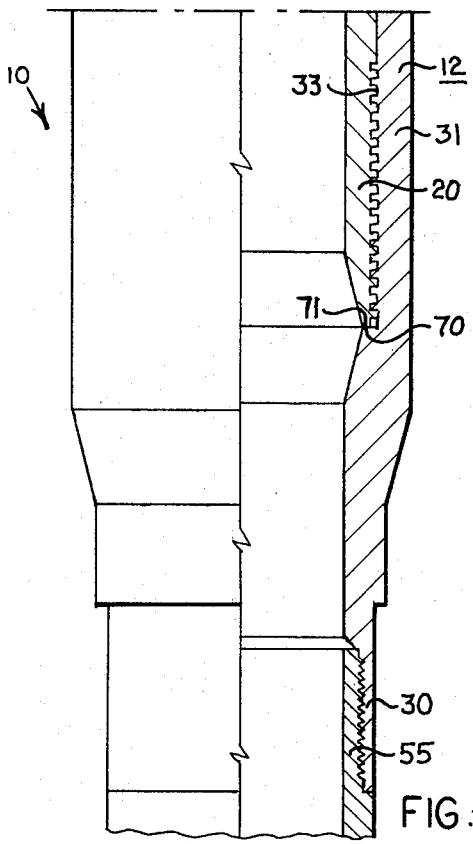
Figure 5:
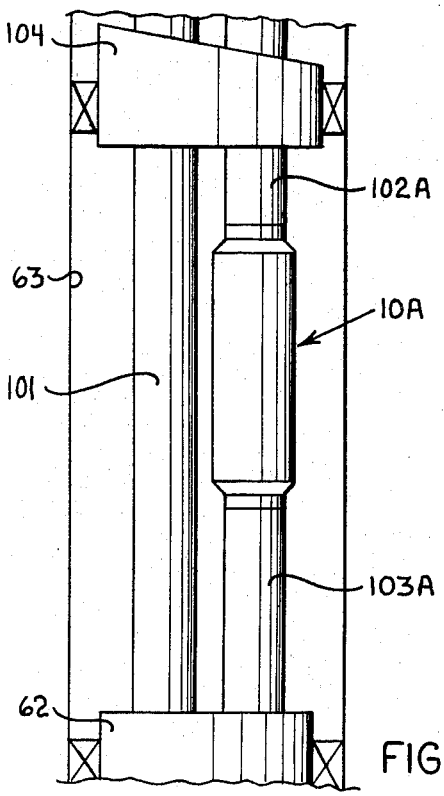
Figure 4:
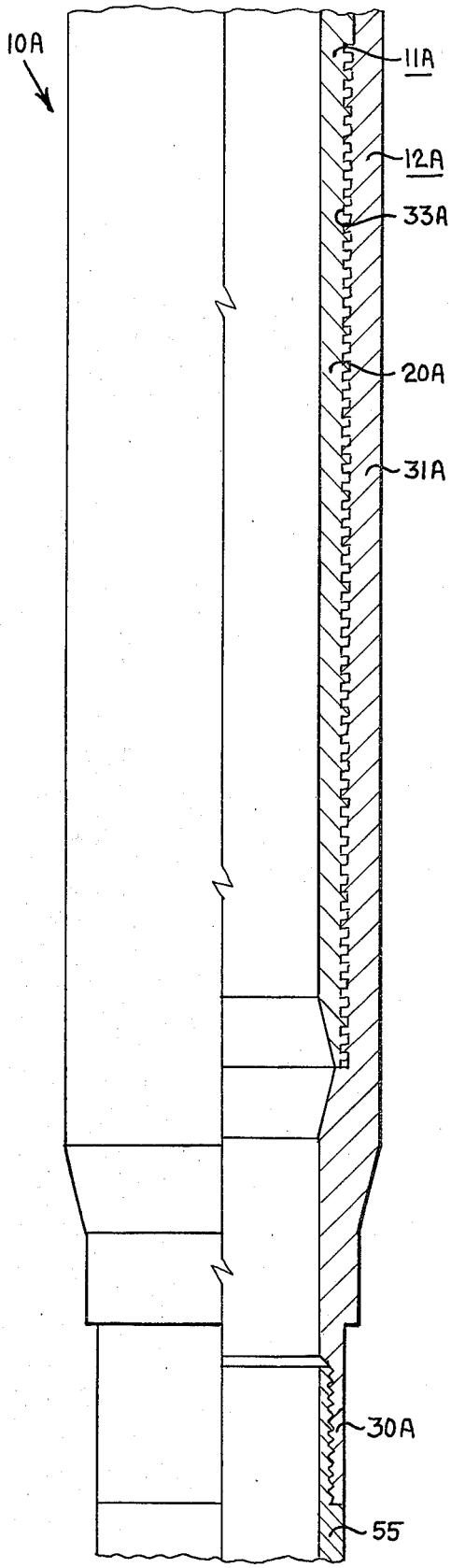

FIGS. 3A and 3B taken together are a longitudinal view in section and elevation of the orienting form of the adjustable pipe union shown schematically in FIG. 1;

FIG. 4 is a longitudinal view in section and elevation of the lower end of another embodiment of the adjustable pipe union used for spacing-out in a tubing string; and FIG. 5 is a longitudinal schematic view in elevation of a packer and tubing string system employing the form of the adjustable pipe union shown in FIG. 4 in one of the tubing strings.

Referring to FIGS. 3A and 3B, an orienting form of adjustable pipe union 10 embodying the features of the invention includes an inner mandrel 11, an outer mandrel 12, packing 13, a metal-to-metal seal assembly 14, and a jam nut 15. The inner mandrel 11 has an externally threaded lower end portion 20 and an internally threaded upper end portion 21. The outer mandrel 12 has a reduced internally threaded lower end portion 30, a central enlarged bore portion 31, and a further enlarged upper end portion 32. A lower section of the outer mandrel portion 31 is provided with internal threads 33 which are engageable by the externally threaded lower end portion 20 of the inner mandrel 11. Above the threads 33 the outer mandrel portion 31 is provided with two spaced internal annular recesses 34 each of which contains the packing member 13 which is illustrated as a conventional T-seal formed of rubber or a resilient plastic material capable of withstanding the pressures for which the union is designed and the fluids which will flow through the union. Above the recesses 34 the outer mandrel portion 31 is provided with an internal annular recess 35 which with the outer surface of the inner mandrel 11 along the recess defines a pressure chamber 40 between the inner and outer mandrels. An internally threaded port 41 is provided through the outer mandrel portion 31 leading to the recess 35 for communication with the pressure chamber 40. A removable externally threaded plug 42 fits in the port 41 for closing off communication into the pressure chamber. The upper outer mandrel portion 32 is provided with internal threads 43 above an internal annular upwardly facing stop shoulder 44. The metal-to-metal seal 14 is supported on the stop shoulder 44 between the inner and outer mandrels. The seal includes a central wedge-shaped outer seal ring 45 and two opposite end wedge-shaped inner seal rings 50 sized and shaped to mate together between the inner and outer mandrels so that a downward force from the lower end edge of the jam nut 15 forces the upper inner seal ring 50 downwardly applying an expanding force to the outer seal ring 45. The seal rings 45 and 50 may be made of any desired metal such as Monel for sealing between and locking the inner and outer mandrels together. The seal rings may be made of different metals having different hardness characteristics. The jam nut 15 has a reduced externally threaded lower end portion 51 which threads into the upper end portion 32 of the outer mandrel 12.

The lower end edge 52 of the jam nut is a square end edge surface for engaging the metal-to-metal seal assembly to expand the seal assembly when the jam nut is rotated downwardly into the outer mandrel. The jam nut has an enlarged upper end portion 53 which is engageable by a wrench or similar tool for turning the jam nut to thread it downwardly into the outer mandrel. The upper end of the inner mandrel 11 is connectible with a tubing portion 54 which may be a portion of a well tool or the lower end of a tubing section of a tubing string. Similarly the lower end of the outer mandrel 12 of the adjustable union is connectible with an upper end portion 55 of a tubular member which may be a lower tubing section of a tubing string or another well tool such as a well packer.

Referring to FIG. 1, the orienting form of adjustable pipe union 10 is included in a dual tubing string well installation which includes a first tubing string 60 and a second parallel tubing string 61 connected with a well packer 62 which seals with a well bore hole wall 63. A tubing safety valve 64 is included in the tubing string 61. The safety valve has a plurality of longitudinal circumferentially spaced lugs 65. The radial width of the lugs 65 is greater than the distance between the tubing strings 60 and 61 so that if the safety valve 64 were rotated in the tubing string 61, the lugs would engage the tubing string 60 with possible damage to the tubing string. Thus, the interference between the safety valve lugs and the adjacent tubing string 60 prevents properly making up the tubing string 61 with the packer 62 when the tubing string 60 is connected with the packer. The use of the adjustable union 10 allows the tubing string 61 to be connected into the packer 62 and orientation of the safety valve 64 without the lugs 65 engaging the tubing string 60.

In running a well installation as shown in FIG. 1 into a well bore it is necessary that the tubing strings 60 and 61 be connected at the surface end of the well bore with the well packer 62. The sequence of the connection of the two tubing strings into the packer is not particularly important as the use of the adjustable pipe union 10 permits the proper orientation of the tubing safety valve 64 and tightening of the necessary threads along the tubing string 61 regardless of whether the tubing string 61 is installed first or last.

Figure 2:
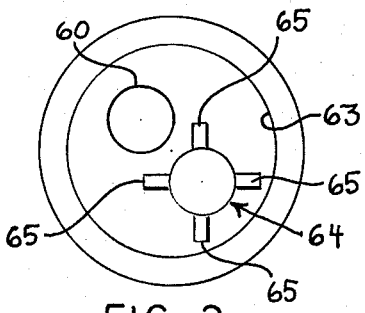
FIG. 2 is a view in section along the line 2—2 of FIG. 1.

Referring to FIGS. 1 and 3A–3B, the well installation is lowered from the surface end of the well bore where the tubing strings 60 and 61 are made up with the well packer 62. The packer may be any one of a number of commercially available well packers provided with flow passages and connecting apparatus for securing with both of the tubing strings. Such packers normally will have threaded top and bottom subs which are connectible with the tubing strings or with threaded nipples which may in turn be connected with the tubing strings. The tubing string 60 may be first connected into one of the vertical passages through the packer 62 following which the tubing string 61 including the adjustable pipe union 10 and the tubing safety valve 64 is connected into the other passage of the packer 62. A short tubular nipple 55 is threaded into the top sub of the packer. The adjustable pipe union 10 is then connected on the nipple 55 by threading the lower end portion 30 of the outer mandrel 12 on the nipple. The connection between the lower end portion 30 of the outer mandrel and the nipple 55 is made up sufficiently tightly to prevent leakage along the connection. The adjustable pipe union is installed on the nipple 55 as a unit with the inner mandrel 11 loosely threaded along the lower end portion 20 of the mandrel into the threads 33 of the outer mandrel 12. The T-seals 13 are in the internal annular recesses 34 of the outer mandrel between the outer mandrel and the outer surface of the inner mandrel 11. The metal-to-metal seal assembly 14 rests loosely within the enlarged upper end bore of the outer mandrel on the stop shoulder 44 between the outer mandrel and the inner mandrel. The jam nut 15 may be loosely engaged in the internally threaded upper end portion 32 of the outer mandrel backed off sufficiently, however, that the lower end edge 52 does not bear against the seal assembly 14. The tubing safety valve 64 is then connected with the internally threaded upper end portion 21 of the inner mandrel by the tubular member 54 which may be either a threaded bottom sub on the safety valve or a connecting nipple between the safety valve and the adjustable pipe union mandrel. The connection between the upper end portion 21 of the mandrel 11 is made up sufficiently tightly to prevent leakage at the connection. The lower end of the section of the tubing string 61 above the tubing safety valve is then threaded into the upper end of the safety valve. The tubing strings 60 and 61 are now connected into the packer 62. It will be recognized that the threaded connection at the lower end of the adjustable pipe union between the portion 30 and the nipple 55 and the threaded connection at the upper end of the pipe union between the upper end portion 21 and the tubular member 54, are tight while the connection of the threads on the lower end portion 20 of the inner mandrel into the threads 33 within the outer mandrel are loose and similarly the jam nut 53 is loosely engaged in the upper end portion 32 of the outer mandrel above the seal assembly 14. In threading the lower end portion 20 of the inner mandrel into the outer mandrel the threads are sufficiently backed off that the lower end edge 70 of the inner mandrel is spaced above the internal annular stop shoulder 71 within the outer mandrel at the lower end of the threads 33. This spacing is sufficient to allow rotation of the inner mandrel in the outer mandrel and thus longitudinal travel of the inner mandrel relative to the outer mandrel sufficient to permit rotation of the tubing safety valve 64 for orientation purposes. It has generally been found that adequate spacing between the lower end of the inner mandrel and the stop shoulder 71 in the outer mandrel need not be more than one inch to allow sufficient rotation of the safety valve to orient the valve so that it will not interfere with the tubing string 60. Also the jam nut 15 is simply loose enough that it does not load the seal assembly 14. The threaded connection between the inner and outer mandrels at the threads 33 is sufficiently loose that the inner mandrel may be turned relative to the outer mandrel by hand. The tubing safety valve 64 and the inner mandrel 11 are turned as a unit sufficiently to properly orient the tubing safety valve so that the longitudinal lugs 65 are clear of the tubing 60 positioned approximately as shown in FIG. 2. The loose connection between the lower end of the inner mandrel 11 and the threads 33 in the outer mandrel permits this free rotation of the safety valve for orientation of the valve relative to the tubing string 60. With the valve 64 properly oriented the jam nut 15 is screwed farther into the upper end portion 32 of the outer mandrel 12 forcing the lower end edge 52 of the jam nut against the metal-to-metal seal assembly 14. The tapered inner and outer surfaces of the outer ring 45 and the inner ring 50 of the seal assembly force the inner rings inwardly as the downward load is applied by the jam nut to the seal assembly. The inner rings tightly grip the outer surface of the inner mandrel locking the inner mandrel relative to the outer mandrel. The lower inside corner of the lower inner ring 50 jams into the corner between the stop shoulder 44 at the lower end of the head portion 32 of the outer mandrel and the outer surface of the inner mandrel 11 effecting a metal-to-metal seal between the inner and outer mandrels. Thus the metal-to-metal seal assembly 14 and the jam nut 15 provide a seal between the inner and outer mandrels of the pipe union and lock the mandrels together. The seal assembly 14 and the T-seals 13 provide a double seal between the inner and outer mandrels insuring against leakage from the tubing string outwardly between the mandrels.

After adjustable pipe union 10 has been tightened the connection between the inner and outer mandrels may be tested by means of the annular test pressure chamber 40. The plug 42 is removed and a suitable source of fluid pressure is applied through the port 41 into the annular test chamber 40. The pressure may be set at a desired predetermined level and held for a given length of time to insure that the seals formed by the T-seals 13 and the seal assembly 14 are effective. If desired a sealing material such as an epoxy resin may be injected through the port 41 into the annular chamber 40 where the material sets up forming both an additional pressure seal and a lock supplementing that provided by the seal assembly 14 between the inner and outer mandrels.

A modified form 10A of adjustable pipe union embodying the features of the invention for spacing-out between fixed members such as packers is represented in FIG. 4. The lower end portion of the adjustable pipe union 10A is specifically shown in FIG. 4. The upper end portion of the adjustable pipe union 10A is identical to the upper portion of the pipe union 10 and is thus illustrated in FIG. 3A. Thus, FIGS. 3A and 4 taken together illustrate the modified spacing-out form of adjustable pipe union 10A. The only difference in the pipe union 10A and the pipe union 10 is in the length of the inner and outer mandrels and the threaded connections between the mandrels whereby the pipe union 10A has substantially more longitudinal adjustability or travel than the pipe union 10. Referring particularly to FIG. 4, the lower end portion of the mandrel 11A is externally threaded to engage the internal threads 33A along the length of the lower end portion 31A of the outer mandrel 12A. With the exception of the lengthened connecting threaded sections of the inner and outer mandrels, all other features of the adjustable pipe union 10A are identical to the adjustable pipe union 10. The lengthened portions of the inner and outer mandrels 11A and 12A along with the threaded sections of such portions provide for approximately one foot of adjustment or travel between the inner and outer mandrels so that a length or section of tubing string including the adjustable pipe union 10A may be varied in overall length by approximately one foot for spacing-out purposes. The upper end portion of the inner mandrel 11A is internally threaded and connectible with an externally threaded tubular member 54 as represented in FIG. 3A. Similarly the lower end portion 30A of the outer mandrel 12A is internally threaded for connection with an externally threaded tubular member 55 as shown in FIG. 4.

FIG. 5 schematically shows a tubing string installation in a well bore 63 which includes spaced packers 62 and 104 connected together by a first tubing string 101 and a second tubing string comprising the tubing sections 102A and 103A coupled together by the adjustable pipe union 10A. The reason for the requirement of the adjustable pipe union 10A is that after the fixed length of tubing string 101 is connected with the packers 62 and 104, the distance between the packers is fixed, the packers cannot be rotated for connection with another tubing string, and therefore a second tubing string can be made up between the packers by use of the adjustable pipe union in the tubing string allowing the tubing string to be a first shorter length for positioning between the packers and extendible to a second length and rotatable for connection with each of the packers at the ends of the string. The two tubing strings are made up with the packers at the surface prior to lowering into the well bore. The two packers are first connected together by the tubing string 101. Next, with the inner and outer mandrels 11A and 12A of the adjustable pipe union 10A threaded together as shown in FIG. 4 so that the pipe union is of minimum length, the upper end of the inner mandrel is threaded to the lower end of the upper tubing section 102A which may be the tubular member 54 as represented in FIG. 3A. Then, the lower end 30A of the outer mandrel 12A is threaded to the upper end of the lower tubing section 103A which may be the tubular member 55 as shown in FIG. 4. The sum of the lengths of the upper tubing section 102A, the adjustable pipe union 10A, and the lower tubing section 103A with the adjustable pipe union at minimum length is less than the distance between the packers 62 and 104 by an amount which is less than the permissible extension of the adjustable pipe union or the permissible travel between the inner and outer mandrels. Stated otherwise, the total combined lengths of the upper and lower tubing sections and the adjustable pipe union must be greater than the distance between the two packers when the pipe union is extended to maximum length and sufficiently less than the distance between the packers when the pipe union is at minimum length to permit the tubing string to be placed between the packers for connection with the packers. After the tubing string is positioned between the packers and properly aligned, one end of the tubing string is first secured with one of the packers and the other end thereafter secured with the other of the packers by rotation between the inner and outer mandrels of the adjustable pipe union. For example, the lower end of the lower tubing section 103A may be screwed to the lower packer 62. The ease of rotation between the inner and outer mandrels of the adjustable pipe union then permits the inner mandrel 11A along with the upper tubing section 102A to be rotated extending the length of the adjustable pipe union until the upper end of the tubing section 102A is screwed into the upper packer 104. As previously indicated the connection between the inner and outer mandrels along the threads 33A of the outer mandrel is sufficiently loose that the mandrels may be turned one relative to the other by hand. After the upper tubing section and the lower tubing section are connected respectively with the upper and lower packers by extension of the adjustable pipe union, the jam nut 15 is then threaded downwardly farther into the outer mandrel 12A until the metal-to-metal seal assembly 14 is loaded and therefore expanded as previously described to form a metal-to-metal seal between the inner and outer mandrels and lock the mandrels together. The effectiveness of the seal formed by the seal assembly 14 is then tested by applying pressure into the annular test chamber 40 between the mandrels as previously described. The chamber 40 may then be filled with epoxy resin if desired to further seal between the mandrels and provide an additional lock between the mandrels. The two packers connected together by the tubing string may then be lowered into the well bore.

Both forms of the adjustable pipe union described and illustrated permit the adjustment of a tubing string for rotational orientation in one instance and for spacing-out purposes in another application wherein no longitudinal loading is placed upon the threaded connection between the adjustable mandrels of the pipe union. Thus, thread damage is not as likely to occur as in conventional available adjustable pipe unions. Further, both forms of the adjustable pipe union described and illustrated include a metal-to-metal seal assembly in addition to more conventional ring seals formed of rubber or suitable synthetic material. A still further form of seal and lock function is provided in both forms of the adjustable pipe union by the internal annular chamber which permits the injection of an epoxy resin. This chamber also permits testing of the seal between the mandrels of the union by injection of a fluid test pressure.

What is claimed is:

1. An adjustable pipe union comprising: an outer tubular mandrel having a first internally threaded end portion provided with an internal annular stop shoulder facing said first end portion at the inward end of the threads provided along said end portion, an intermediate bore portion smaller than the bore along said first end portion, internal annular packing recess means in said mandrel around said intermediate bore portion between said stop shoulder and said second end of said mandrel, packing means in said packing recess means for sealing between said outer mandrel and an inner mandrel therein, and internal annular longitudinal threads formed in said outer mandrel along said intermediate bore portion between said packing recess means and said second end of said mandrel, a second opposite end portion of said outer mandrel having a bore portion smaller than said intermediate bore portion of said outer mandrel and provided with longitudinal threads for connecting said second end portion of said outer mandrel with an adjacent tubular member; an inner tubular mandrel sized to telescope into said outer mandrel through said first and said intermediate bore portions of said outer mandrel, said inner mandrel having a first end portion provided with threads engageable with said longitudinal threads along said intermediate portion of said outer mandrel, said threads along said inner mandrel first end portion and said mandrel intermediate portion permitting said inner mandrel to rotate in said outer mandrel for rotational and longitudinal adjustment of said inner mandrel in said outer mandrel, and said inner mandrel having a second opposite end portion provided with threads for connection of said second end portion of said inner mandrel with an adjacent tubular member; annular lock means within said first internally threaded end portion of said outer mandrel around said inner mandrel on said stop shoulder within said outer mandrel; and a tubular jam nut having an externally threaded end portion engaged in said threads along said first end portion of said outer mandrel, said jam nut having an end edge engageable with said annular lock means for expanding lock means to provide a lock between said inner and outer mandrels, and said jam nut having an enlarged second end portion extending along said inner mandrel from said first end portion of said outer mandrel providing a surface portion of said nut for engagement of a tool for rotation of said jam nut whereby said jam nut may be threaded into said first end portion of said outer mandrel against said annular lock means.

2. An adjustable pipe union in accordance with claim 1 wherein said lock means comprises wedge-shaped seal rings adapted to expand radially responsive to a force applied to one of said rings by an end edge of said jam nut for locking said inner and outer mandrels together.

3. An adjustable pipe union in accordance with claim 2 wherein said threads along said intermediate bore portion of said outer mandrel and said threads along said first end portion of said inner mandrel are of sufficient length to permit rotation of one of said mandrels relative to the other of said mandrels for rotational orientation of a well tool member connected with one of said mandrels less than 360°.

4. An adjustable pipe union in accordance with claim 2 wherein said threads along said intermediate bore portion of said outer mandrel and along said first end portion of said inner mandrel are of sufficient length to permit relative rotation between said mandrels to perform a spacing-out function in a tubing string including said adjustable pipe union.

5. An adjustable pipe union in accordance with any one of claims 1, 2, 3 or 4, including an annular chamber defined within said outer mandrel around said inner mandrel for testing the seal between said mandrels and for injection of a liquid sealant between said mandrels, a port into said annular chamber through said outer mandrel, and a removable plug for said port.

6. An adjustable pipe union comprising: an outer tubular mandrel having a first internally threaded end portion provided with an internal annular stop shoulder facing said first end portion at the inward end of the threads provided along said end portion, an intermediate bore portion smaller than the bore along said first end portion, an internal annular recess defining an annular test chamber within said intermediate bore portion spaced from said stop shoulder toward the second opposite end of said mandrel, port means provided through said mandrel into said test chamber, plug means for closing said port into said test chamber, longitudinally spaced internal annular packing recesses in said mandrel around said intermediate bore portion between said test chamber and said second end of said mandrel, a ring packing member in each of said packing recesses for sealing between said outer mandrel and an inner mandrel therein, and internal annular longitudinal threads formed along said outer mandrel along said intermediate bore portion between said packing recesses and said second end of said mandrel, a second opposite end portion of said mandrel having a bore portion smaller than said intermediate bore portion of said outer mandrel and provided with longitudinal threads for connecting said second end portion of said outer mandrel with an adjacent tubular member; an inner tubular mandrel sized to telescope into said outer mandrel through said first and said intermediate bore portions of said outer mandrel, said inner mandrel having a first externally threaded end portion engageable with said longitudinal threads along said intermediate portion of said outer mandrel, and said inner mandrel having a second opposite end portion provided with threads for connection of said second end portion of said inner mandrel with an adjacent tubular member; an annular metal-to-metal seal assembly within said first internally threaded end portion of said outer mandrel around said inner mandrel on said stop shoulder within said outer mandrel; and a tubular jam nut having an externally threaded end portion engaged in said threads along said first end portion of said outer mandrel, and said jam nut having an edge engageable with said metal-to-metal seal assembly for expanding said seal assembly to provide a lock and a seal between said inner and outer mandrels, and said jam nut having an enlarged second end portion extending along said inner mandrel from said first end portion of said outer mandrel providing a surface portion of said nut for engagement of a tool for rotation of said jam nut whereby said jam nut may be threaded into said first end portion of said outer mandrel against said metal-to-metal seal assembly.

7. An adjustable pipe union in accordance with claim 6 wherein said metal-to-metal seal assembly comprises two wedge-shaped seal rings defining opposite end portions of said seal assembly and a wedge-shaped outer seal ring positioned concentrically around said inner seal rings, outer tapered surfaces of said inner seal rings being engageable with inner tapered surfaces of said outer seal ring whereby said seal assembly is expanded radially responsive to a force applied to one of said inner seal rings by an end edge of said jam nut for sealing between and locking said inner and outer mandrels together.

8. An adjustable pipe union in accordance with claim 7 wherein said threads along said intermediate bore portion of said outer mandrel and said threads along said first end portion of said inner mandrel are of sufficient length to permit rotation of one of said mandrels relative to the other of said mandrels for rotational orientation of a well tool member connected with one of said mandrels less than 360°.

9. An adjustable pipe union in accordance with claim 7 wherein said threads along said intermediate bore portion of said outer mandrel and along said first end portion of said inner mandrel are of sufficient length to permit relative rotation between said mandrels to perform a spacing-out function in a tubing string including said adjustable pipe union.

* * * * *